United States Patent [19]

Cass

[11] 4,046,306

[45] Sept. 6, 1977

[54] COMPOSITE END PANEL FOR CAN OR SIMILAR CONTAINER

[75] Inventor: Ann E. Cass, Argo, Ill.

[73] Assignee: The Continental Group, Inc., New York, N.Y.

[21] Appl. No.: 645,966

[22] Filed: Jan. 2, 1976

[51] Int. Cl.[2] ..... B65D 3/10; B21D 31/00

[52] U.S. Cl. ..... 229/5.7; 113/120 XY; 113/120 Y; 113/121 C; 156/69; 220/67; 229/DIG. 12

[58] Field of Search ..... 113/1 E, 1 F, 120 A, 113/120 K, 120 V, 120 XY, 120 Y, 120 R, 121 R, 121 A, 121 C, 121 AB; 156/69; 215/246; 229/5.5, 5.7, 5.8, DIG. 12 220/67;81 R

[56] References Cited

U.S. PATENT DOCUMENTS

| | | | |
|---|---|---|---|
| 874,346 | 12/1907 | Krummel | 156/69 UX |
| 1,718,322 | 6/1929 | Walker | 113/120 Y |
| 2,176,950 | 10/1939 | Aument | 113/120 XY |
| 2,413,449 | 12/1946 | Hatch | 156/69 X |
| 2,801,946 | 8/1957 | Evenblis | 156/69 |
| 3,824,138 | 7/1974 | Karoboth et al. | 156/69 |

*Primary Examiner*—Leon Gilden

*Attorney, Agent, or Firm*—John J. Kowalik; Joseph E. Kerwin; William A. Dittmann

[57] ABSTRACT

A composite end panel is adhesively bonded to the sidewall of a can or similar container with the end panel periphery overlying a portion of the sidewall outer surface. A plastic band or hoop is placed on the sidewall, overlapping the edge of the end panel, and shrunk in place through the application of heat. The band seals the cut edge and prevents wicking while insuring that the end panel is retained in position. A fillet of sealant may be applied to the inside of the container at the juncture of the sidewall and the end panel.

10 Claims, 5 Drawing Figures

COMPOSITE END PANEL FOR CAN OR SIMILAR CONTAINER

SUMMARY OF THE INVENTION

Use of composite or laminated paper end panels on cans or similar containers has generally proven unstaisfactory due to separation of the end panel from the container sidewall and "wicking " or absorption of liquids at the cutedge of the end panel. Further, forming of the laminate to the desired end panel configuration has heretofore resulted in severe wrinkling and delamination of the composite material.

Accordingly it is the primary object of the present invention to provide an improved laminated paper end panel and method of applying the same to a can or similar container such that the problems of end panel separation, wicking, wrinkling and delaminating are essentially eliminated.

With the above and other objects in view that will hereinafter appear, the nature of the invention will be more clearly understood by reference to the following description, the claims and the several views illustrated in the accompanying drawings. DESCRIPTION OF THE DRAWINGS FIG. 1 is a top plan view of the end panel blank prior to forming.

DESCRIPTION OF THE PREFERRED EMBODIMENT

Figure 1:
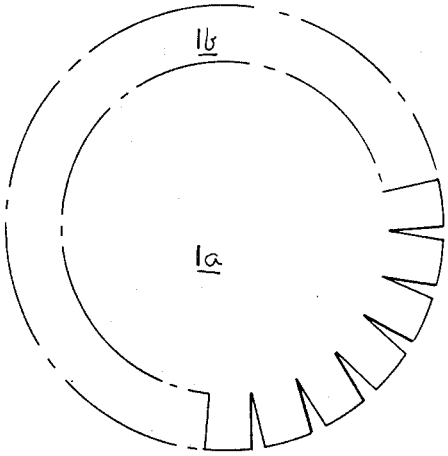
Figure 4:
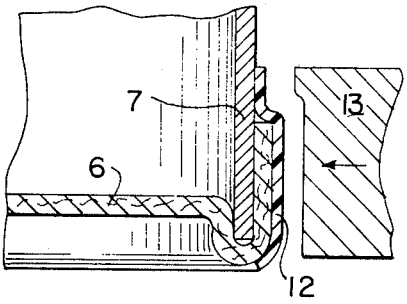
FIG. 4 is a fragmentary cross-sectional view illustrating heat sealing of the plastic band to the body.

As shown in FIG. 1, there is provided a planar end panel blank 1, comprising a circular central panel portion 1*a* and a peripheral gusset portion 1*b* for increased flexibility.

Figure 2:
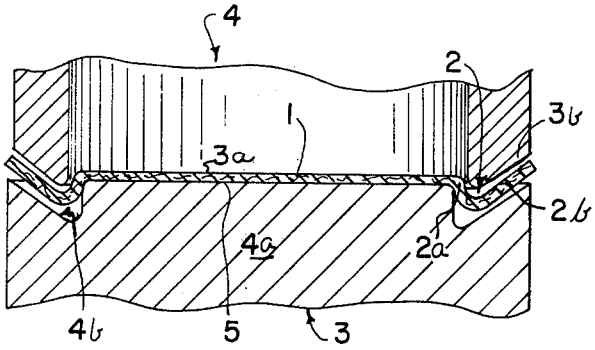
FIG. 2 is a fragmentary cross-sectional view illustrating the blank being formed.
Figure 5:
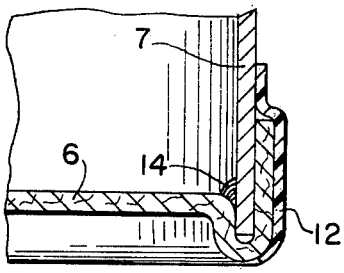
FIG. 5 is a fragmentary cross-sectional view illustrating the placement of the internal sealant fillet.

As shown in FIG. 2, the gusset portion 1*b* of the end panel blank 1 is formed with an annular channel 2 having a substantially vertical inner sidewall 2*a* and an upwardly and outwardly sloping outer sidewall 2*b*. The channel formation is accomplished through the use of a die 3 and split punch 4. The die has a substantially horizontal planar central face 3*a*, corresponding in size to the central panel portion 1*a* of the end panel, and an annular recessed channel face 3*b* configured to receive the gusset portion 1*b* of the blank 1. The punch 4 includes a central segment 4*a*, having a substantially horizontal planar face 5, and an outer annular channel portion 4*b* configured to mate with the channel 3*b* of the die 3.

During the channel formation operation, the end panel blank 1 is clampingly held between the central face 3*a* of the die 3 and the horizontal face 5 of the punch 4. The outer portion 4*b* of the punch 4 is then displaced toward the die 3 to form the gusset portion 1*b* to the desired contour.

Figure 3:
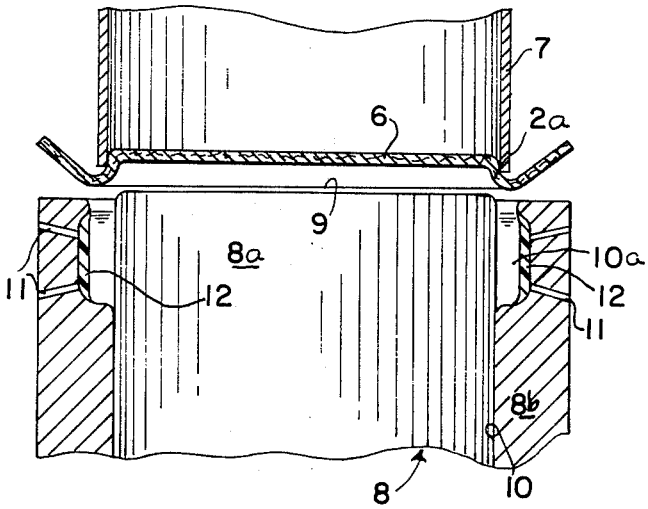
FIG. 3 is a fragmentary cross-sectional view illustrating the preformed blank being attached to a can body.

After the blank 1 has been formed, the inner or upper surface of the channel 2 is coated with a suitable adhesive. The preformed end panel 6 is now joined to the can body or sidewall 7. As illustrated in FIG. 3, an end of the body 7 is placed over the preformed blank 6 with the inner surface of the body 7 in close contact with the inner sidewall 2*a* of the channel 2.

Final assembly of the end panel to the body 7 is accomplished on a split forming tool 8 comprising a central portion 8*a*and an outer portion 8b. the central portion 8*a* includes a substantially horizontal planar face 9; sized to receive the partially assembled container thereon.

An annular recess 10*a* is formed in the sidewall 10 of the outer portion 8*b* of the tool 8, near the upper end thereof and the section of the sidewall 10 between the recess 10*a* and the upper end of the outer portion 8*b* is recessed sufficiently to permit passage of the completed end panel/body seam as will be more clearly understood by reference to the mode of operation of the tool 8. A plurality of passages 11 are formed in the outer portion 8*b* and communicate with the recess 10*a*.

In the final assembly operation, a heat-shrinkable band or hoop 12, formed of a suitable plastic material, is placed within the recess 10*a* in the outer portion 8*b* and the partially assembled container is placed on the central portion 8*a* of the tool 8 with the central panel portion 1*a* of the end panel resting on the horizontal face 9. The outer portion 8*b* of the tool 8 is then advanced upwardly, forcing the protruding channel sidewall 2*a* upwardly and inwardly to a position abutting the outer surface of the body 7. The movement of the tool 8 also beings the band 12 into position overlying the sidewall 2*a* and overlapping the upper edge thereof. When the band 12 is in position, hot air is introduced into the recess 10*a* through the passages 11, causing the band 12 to shrink against the end panel channel sidewall 2*a* and the container body 7 thereby securing the end panel in position and sealing the upper edge thereof.

After the container is removed from the forming tool 8, the band 12 is heat sealed to the outer surfaces of the body 7 and the outer sidewall 2*b*, by a heat seal die 13, thereby providing a moisture proof barrier. An inner fillet 14 of sealant may be applied to the interior of the container at the juncture of the body 7 and the end panel to further insure the integrity of the joint.

While the preferred method of application and arrangement of parts and tooling has been shown in illustrating the invention, it is to be clearly understood that various changes in details and arrangement of parts or tooling may be made without departing from the scope and spirit of the claims appended hereto.

I claim:

1. An improved method of fastening a paper laminate panel to the body of a can or similar container comprising the steps of:

cutting the end panel, having interior and exterior surfaces, from a sheet of laminate material, applying an adhesive sealant to the interior surface periphery of said end panel.

securing sand adhesive-covered end panel to an end of said container body with at least a portion of said interior surface periphery overlying the outer surface of said body, applying an annular band or hoop of heat-shrinkable plastic over the exterior surface periphery of said end panel, and heating said band or hoop to shrink the same, thereby further securing said end panel to said body and preventing end panel delamination and separation.

2. An improved method of fastening a paper laminate end panel to the body of a can or similar container comprising the steps of:

cutting the end panel from a sheet of laminate material, applying an adhesive sealant to the periphery of said end panel, securing said adhesive covered end panel to an end of said container body with at least a portion of said periphery overlying the outer surface of said body, said end panel being formed with a plurality of gussets in said periphery to enhance the flexibility thereof, whereby said end panel may be attached to said body without excessive wrinkling, applying an annular band of heat shrinkable plastic over said end panel periphery, and heating said band to shrink said plastic thereby further securing said end panel to said body and preventing end panel delamination and separation.

3. The method of claim 2, wherein an annular channel is formed in said periphery of said end panel prior to securing the same to said body, said channel having a substantially vertical inner sidewall and an upwardly and outwardly sloping outer sidewall, the nonchannel portion of said end panel being of a size admitting said container body to fit thereover, with said body in close contact with said inner sidewall of said channel.

4. The method of claim 3, wherein said band overlaps the edge of said end panel, thereby sealing said edge and preventing wicking.

5. The method of claim 4, and the upper edge of said band is heat sealed to said body, thereby improving the moisture resistance of the seal.

6. The method of claim 4, and a fillet of sealant on the interior of the container at the juncture of said body and said end panel.

7. An improved container comprising a container body, a laminated end panel adhesively attached to an end of said body, said end panel comprising a central panel portion and a peripheral portion, said peripheral portion having a plurality of flexibility enhancing gussets formed therein, at least at part of said peripheral portion being attached to the outer surface of said body, and an annular band of heat-shrinkable plastic material overlying the part of said peripheral portion attached to said outer body surface for further securing said end panel to said body and preventing end panel delamination and separation.

8. The container of claim 7, wherein an annular channel is formed in said peripheral portion, said channel having a substantially vertical inner sidewall, and said central panel portion being of a size admitting said body to fit thereover, with said body in close contact with said inner sidewall of said channel.

9. The container of claim 8, wherein said band overlaps the edge of said end panel, thereby sealing said edge and preventing wicking.

10. The method of claim 9 and a fillet of sealant on the interior of the container at the juncture of said body and said end panel.

* * * * *